United States Patent [19]

Negoro et al.

[11] Patent Number: 4,890,140

[45] Date of Patent: Dec. 26, 1989

[54] IMAGE FIXING APPARATUS

[75] Inventors: Ikuo Negoro, Sakado; Masahiro Kita, Tokyo, both of Japan

[73] Assignee: Asahi Kogaku Kogyo K.K., Tokyo, Japan

[21] Appl. No.: 177,352

[22] Filed: Apr. 1, 1988

[30] Foreign Application Priority Data

Apr. 3, 1987 [JP] Japan ..... 62-82605
Apr. 24, 1987 [JP] Japan ..... 62-62402
Apr. 24, 1987 [JP] Japan ..... 62-62403

[51] Int. Cl.[4] ..... G03G 15/20; G03G 21/00

[52] U.S. Cl. ..... 355/290; 219/216; 226/74; 226/172

[58] Field of Search ..... 355/3 R, 3 FU, 14 FU, 355/3 SH, 282, 285, 289, 290; 226/74, 170, 172, 173; 219/216

[56] References Cited

U.S. PATENT DOCUMENTS 3,227,344 1/1966 Rutter ..... 226/172 X
3,490,668 1/1970 Dean et al. ..... 226/172 X
3,669,327 6/1972 Dowd ..... 226/74 X
4,213,551 7/1980 Wihdele ..... 226/74
4,218,499 8/1980 Shinohara et al. ..... 355/3 FU X
4,226,353 10/1980 Blaskovic et al. ..... 226/74
4,407,580 10/1983 Hashimoto et al. ..... 355/3 BE X
4,419,003 12/1983 Fujie et al. ..... 355/3 FU
4,569,468 2/1986 Neer ..... 226/74

*Primary Examiner*—Fred L. Braun
*Attorney, Agent, or Firm*—Sandler & Greenblum

[57] ABSTRACT

In an image fixing apparatus, a fixing roll unit is arranged in a predetermined path along which a continuous form travels, for applying pressure and/or heat to an image on the continuous form to fix the image thereonto. An endless belt member is arranged upstream of the fixing roll unit with reference to a transport direction in which the continuous form travels along the predetermined path. The endless belt member has provided thereon a plurality of projections arranged in spaced relation to each other along an outer periphery of the endless belt member. The projections are engageable with sprocket holes formed in the continuous form along opposite side edges thereof. The endless belt member is capable of running in the transport direction while applying a predetermined back-tension to the continuous form traveling toward the fixing roll unit along the predetermined path.

29 Claims, 10 Drawing Sheets

Fig. 10A
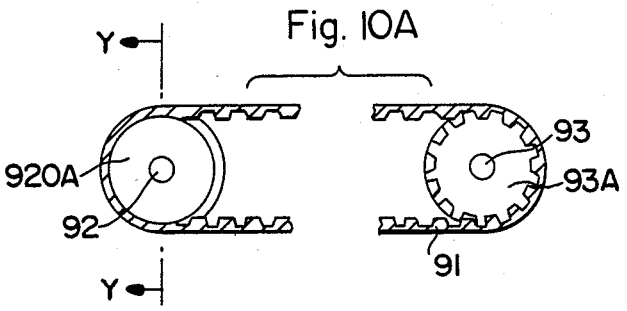
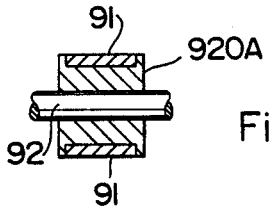
Fig. 10B
Fig. 9A
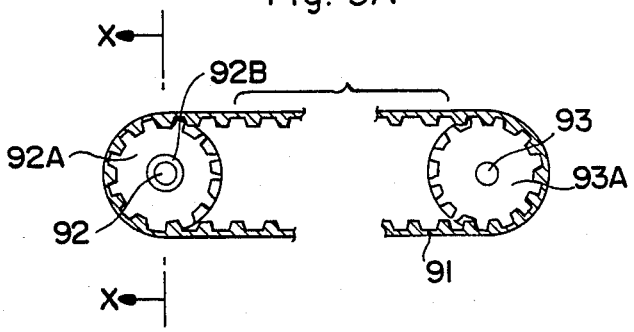
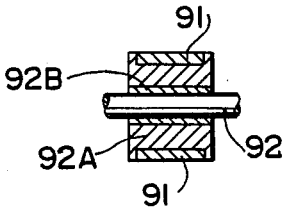
Fig. 9B

IMAGE FIXING APPARATUS

BACKGROUND OF THE INVENTION

This invention relates to an image fixing apparatus for fixing an image transferred onto a continuous form and, more particularly, to a mechanism for preventing meandering of the continuous form in the image fixing apparatus.

Conventionally, there is known an image recording device utilizing a so-called electrophotographic system in which a surface of a photoconductive drum, for example, is exposed to form a latent image on the drum surface, toner is then applied to the latent image to develop the image, and the developed image is transferred onto a recording sheet material and is fixed by a fixing apparatus. Such image recording device is chiefly employed in a copying machine. In general, cut sheets are used as the recording sheet material, and a heat-roll fixing system is utilized wherein the toner is fixed by heat as well as pressure. In addition, a pressure-fixing system has recently been developed, which is low in electric power consumption and which does not require an amount of time for preheating the heat rolls.

In recent years, the image recording device utilizing the electrophotographic system has also been employed in a printer or the like which prints out the output from a computer. In such image recording device, it has been desired to use, as the recording material, a continuous recording form identical with that used in a conventional line-printer.

The continuous recording form identical with the conventional one is a folded continuous recording form (hereinafter referred to simply as "continuous form") called a fan-folded form which has formed therein sprocket holes. Perforation is provided at each of the folded sections to enable sheet sections to easily be severed from each other.

In the above heat-roll fixing system or the pressure-fixing system, a continuous form having carried thereon unfixed toner image is clamped between a pair of rotating fixing rolls and is heat-pressurized or pressurized thereby, so that the toner image is squeezed onto the continuous form and is fixed thereonto. Usually, the continuous form is driven to travel by rotation of the fixing rolls.

When the above fixing systems are applied to the continuous form, the following fatal problem might arise. That is, the continuous form clamped between the fixing rolls would skew or meander because of various factors such as poor initial biting of the continuous form into the nip between the fixing rolls, unevenness or nonuniformity in thickness of the continuous form, elongation of the continuous form due to absorption of moisture, and the like. If such skewing or meandering occurs, the biting position of the continuous form with respect to the fixing rolls consecutively varies laterally, so that the side edge of the continuous form finally reaches the lateral end of the nip between the fixing rolls. This causes creases in the continuous form, resulting in defective fixing of the image and in defective transportation of the continuous form.

Such skewing or meandering of the continuous form does not occur in the case of cut sheets, because the cut sheets are limited in length, i.e., are relatively short in length.

SUMMARY OF THE INVENTION

It is therefore an object of this invention to provide an improved image fixing apparatus capable of preventing skewing or meandering of a continuous form, and also capable of automatically restoring the continuous form to a predetermined position even if skewing or meandering of the continuous form occurs.

For the above purpose, according to the invention, there is provided an image fixing apparatus for fixing an image on a continuous form to record the image thereonto, the continuous form having sprocket holes formed along each of opposite side edges of the continuous form, which comprises:

drive means for driving the continuous form to travel along a predetermined path;

fixing roll means arranged in the predetermined path, for applying pressure and/or heat to the image to fix the same onto the continuous form; and endless belt means arranged upstream of the fixing roll means with reference to a transport direction in which the continuous form travels along the predetermined path, the endless belt means having provided thereon a plurality of projections arranged in spaced relation to each other along an outer peripheral surface of the endless belt means, the projections being engageable with the sprocket holes formed in the continuous form, the endless belt means being capable of running in the transport direction while applying a predetermined back-tension to the continuous form traveling toward the fixing roll means along the predetermined path.

According to another aspect of the invention, there is provided an image fixing apparatus for fixing an image on a continuous form to record the image thereonto, the continuous form having sprocket holes formed along each of opposite side edges of the continuous form, which comprises:

drive means for driving the continuous form to travel along a predetermined path;

fixing roll means arranged in the predetermined path, for applying pressure and/or heat to the image to fix the same onto the continuous form;

a pair of first and second endless belts arranged upstream of the fixing roll means with reference to a transport direction in which the continuous form travels along the predetermined path, the first and second endless belts being capable of running in parallel relation to the transport direction and being spaced from each other perpendicularly to the transport direction, each of the first and second endless belts having provided thereon a plurality of projections arranged in spaced relation to each other along an outer peripheral surface of the endless belt, the projections on each of the first and second endless belts being engageable with the sprocket holes formed along a corresponding one of the opposite side edges of the continuous form;

a pair of first and second pulley means arranged in spaced relation to each other along the predetermined path, at least the first pulley means of the first and second pulley means having a pair of spaced pulleys, the first endless belt passing around one of the pair of pulleys and the second pulley means, and the second endless belt passing around the other pulley and the second pulley means;

a shaft having an axis extending perpendicularly to the transport direction, the pair of pulleys being mounted on the shaft, the shaft being rotatable about its axis with a predetermined rotational resistance to impart a resistance to running of the first and second endless belts thereby applying a predetermined back-tension to the continuous form traveling toward the fixing roll means along the predetermined path; and rotation control means arranged between at least one of the pair of pulleys and the shaft, for preventing the at least one pulley from rotating relative to the shaft in a running direction of one of the first and second endless belts, which is associated with the at least one pulley, but for permitting the at least one pulley to rotate relative to the shaft in a direction opposite to the running direction.

According to still another aspect of the invention, there is provided an image fixing apparatus for fixing an image on a continuous form to record the image thereonto, the continuous form having sprocket holes formed along each of opposite side edges of the continuous form, which comprises:

drive means for driving the continuous form to travel along a predetermined path;

fixing roll means arranged in the predetermined path, for applying pressure and/or heat to the image to fix the same onto the continuous form;

a pair of first and second endless belts means arranged upstream of the fixing roll means with reference to a transport direction in which the continuous form travels along the predetermined path, the first and second endless belt means being capable of running in the transport direction while clamping the continuous form between the first and second endless belt means;

a plurality of projections provided on the first endless belt means and arranged in spaced relation to each other along an outer peripheral surface of the first endless belt means; and a plurality of fixing bores formed in the second endless belt means and arranged in spaced relation to each other along a periphery of the second endless belt means, wherein the projections are engageable with the sprocket holes formed in the continuous form and are engageable with the fixing bores formed in the second endless belt means through the sprockets holes, and wherein at least one of the first and second endless belt means is capable of running in the transport direction while applying a predetermined back-tension to the continuous form traveling toward the fixing roll means along the predetermined path.

BRIEF DESCRIPTION OF THE ACCOMPANYING DRAWINGS

FIG. 9A is an enlarged side view explaining a rotational resistance generating system of the image fixing apparatus illustrated in FIG. 1;

FIG. 9B is a sectional view taken along the X—X line in FIG. 9A;

FIG. 10A is an enlarged side view showing a modified rotational resistance generating system;

FIG. 10B is a sectional view taken along the Y—Y line in FIG. 10A; and

DETAILED DESCRIPTION

Figure 1:
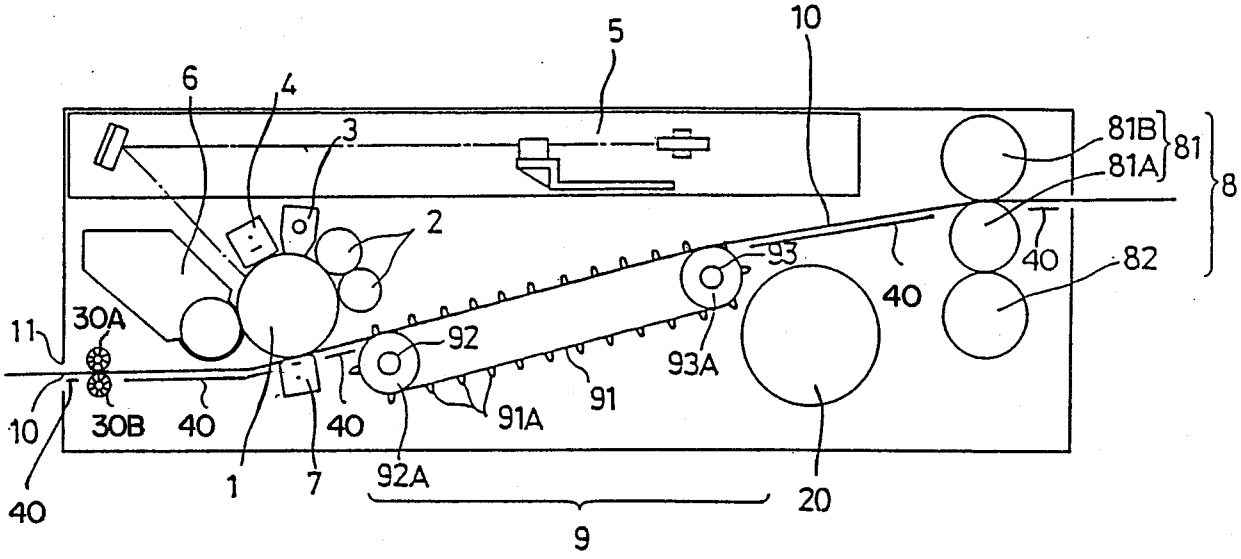
FIG. 1 is a somewhat schematic side elevational view of a laser beam printer having incorporated therein an image fixing apparatus embodying the invention, which is provided with a mechanism for preventing meandering of a continuous form.
Figure 2:
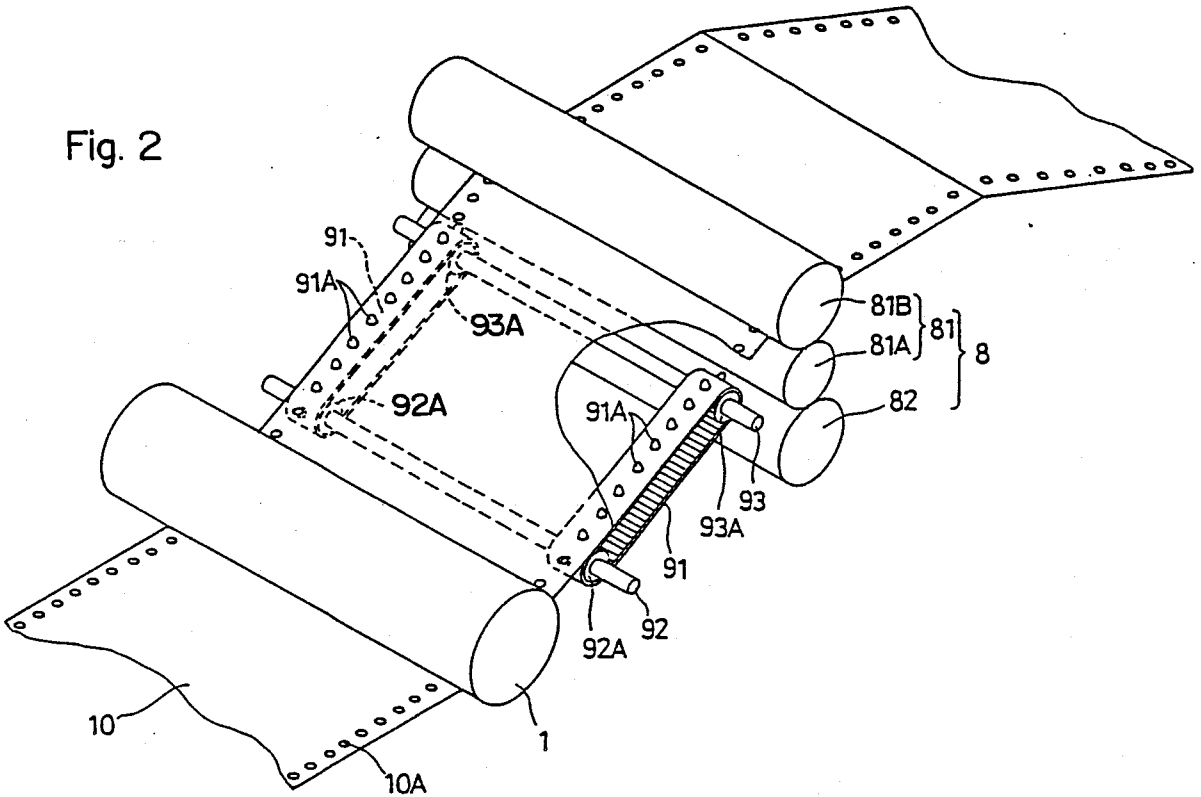
FIG. 2 is a perspective view of the image fixing apparatus illustrated in FIG. 1.

Referring to FIG. 1, an illustrated laser beam printer in which a fan-folded form is used as a continuous recording form. The laser beam printer is designed to print information outputted from a computer or the like, onto the fan-folded form 10 by means of an electrophotographic system, and to output the printed information. As shown in FIG. 2, the fan-folded form 10 has sprocket holes 10A which are formed along each of opposite side edges of the fan-folded form 10 and which are spaced from each other at intervals of ½ inch.

The printer comprises a photoconductive drum 1. Arranged about the photoconductive drum 1 in due order in a rotational direction thereof are a toner-cleaning station 2, a de-charging station 3, a charging station 4, an optical scanning system 5 for leading a laser beam onto the photoconductive drum 1, a developing station 6, and a transferring station 7. A fixing station 8 is arranged downstream of the photoconductive drum 1 with reference to a transport direction in which the fan-folded form 10 travels along a predetermined path. A tension applying mechanism 9 is arranged in the predetermined path at a location between the photoconductive drum 1 and the fixing station 8.

The arrangement is such that the laser beam from the optical scanning system 5 scans the charged surface of the drum 1 along an axis thereof to carry out a main scanning, and the drum 1 is rotated to carry out an auxiliary scanning, to thereby form a latent image on the charged drum surface. Toner is then applied at the developing station 6 to the latent image to develop the same. Subsequently, the developed toner image is transferred at the transferring station 7 onto the fanfolded form 10, and the transferred toner image is fixed at the fixing station 8.

At the fixing station 8, a fixing roll pair 81 is arranged which is composed of a pair of upper and lower pressure rolls 81B and 81A having their respective axes extending perpendicularly to the transport direction of the fan-folded form 10. A backup roll 82 urges the lower pressure roll 81A toward the upper pressure roll 81B.

A gap defined between outer peripheral surfaces of the respective upper and lower pressure rolls 81B and 81A of the fixing roll pair 81 is so set that when the fan-folded form 10 is clamped between both the pressure rolls 81A and 81B, the fan-folded form 10 is pressurized with a predetermined pressure. Designated by the numerals 30A and 30B are a pair of brushing rolls for introducing the continuous form 10 into the interior of the apparatus while preventing the introduction of dust and the like. Further designated by the numerals 40 are guide plates for transferring the continuous form 10 therealong within the apparatus.

The upper pressure roll 81B is connected to a drive motor 20 through a chain (not shown). The upper pressure roll 81B is rotatively driven by the drive motor 20 to clamp the fan-folded form 10 having carried thereon an unfixed image, between the upper and lower pressure rolls 81B and 81A. The upper and lower pressure rolls 81B and 81A cooperate with each other to pressurize the fan-folded form 10 to squeeze the unfixed image thereon, thereby fixing the image onto the fanfolded form 10. This is called a pressure-fixing system. The upper and lower pressure rolls 81B and 81A also cooperate with each other to drive the fan-folded form 10 to travel along the predetermined path, to discharge the fan-folded form 10 having carried thereon the fixed image, out of the printer.

Peripheral speed of the photoconductive drum 1 is brought completely into coincidence with that of the pressure roll pair 81. That is, the fan-folded form 10 is driven to travel at a transport velocity corresponding to the peripheral speed of the pressure roll pair 81.

The tension applying mechanism 9 comprises a pair of endless tension belts 91 and 91 as clearly shown in FIG. 2. The endless tension belts 91 and 91 are arranged below the fan-folded form 10 traveling from the transferring station 7 toward the fixing station 8 along the predetermined path. The endless tension belts 91 and 91 are spaced from each other perpendicularly to the transport direction, and extend parallel to the transport direction and respectively along opposite side edges of the fan-folded form 10.

Each of the endless tension belts 91 is a so-called synchronous belt having an inner peripheral surface formed with teeth in mesh with teeth formed on an outer peripheral surface of each of pulleys 92A and 92B subsequently to be described in detail. A plurality of projections 91A are formed on an outer peripheral surface of the endless tension belt 91. The projections 91A are arranged in a single row along the entire periphery of the endless tension belt 91, and are spaced from each other at intervals of ½ inch so that the projections 91A are engageable respectively with the sprocket holes 10A formed at the same pitch of ½ inch along a corresponding one of the opposite side edges of the fan-folded form 10. That is, the endless tension belt 91 has its length an integer multiplied by the pitch (½ inch) of the sprocket holes 10A. Each of the projections 91A is n the form of a spindle to facilitate insertion of the projection 91A into a corresponding one of the sprocket holes 10A.

A pair of shafts 92 and 93 are fixedly mounted to a chassis (not shown) of the printer. The shafts 92 and 93 have their respective axes extending parallel to each other and perpendicularly to the transport direction of the fan-folded form 10. A pair of pulleys 92A and 92A are mounted on the shaft 92 in spaced relation to each other along the shaft 92. Likewise, a pair of pulleys 93A and 93A are mounted on the shaft 93 in spaced relation to each other along the shaft 93. One of the pair of endless tension belts 91 passes around one of the pair of pulleys 92A and one of the pair of pulleys 93A, while the other endless tension belt 91 passes around the other pulley 92A and the other pulley 93A. Each of the endless tension belts 91 extends parallel to the transport direction of the fan-folded form 10 and has an upper run coincident with the predetermined path along which the fan-folded form 10 travels.

The shafts 92 and 93 are spaced from each other a predetermined distance which is so set that each of the endless tension belts 91 and 91 determined in length by the pitch of the sprocket holes 10A is trained around the corresponding pulleys 92A and 93A with a predetermined tension. The predetermined distance is also set such that ten of the projections 91A on each of the endless tension belts 91 are always fitted and engaged respectively into and with ten of the sprocket holes 10A along a corresponding one of the opposite side edges of the fan-folded form 10.

As described previously, each of the pulleys 92A and 93A has the outer peripheral surface formed with teeth in mesh with the teeth formed on the inner peripheral surface of each endless tension belt 91. The pulleys 93A and 93A on the side of the fixing station 8 are mounted on the shaft 93 for rotation relative thereto. On the other hand, the pulleys 92A and 92A on the side of the photoconductive drum 1 are mounted on the shaft 92 for rotation relative thereto with a predetermined rotational resistance. Thus, each of the pulleys 92A and 92A is adapted to rotate about the axis of the shaft 92 so as to impart a predetermined resistance to running of a corresponding one of the endless tension belts 91 and 91 in the transport direction of the fan-folded form 10.

In order to impart the predetermined rotational resistance to each pulley 92A, as illustrated in FIGS. 9A and 9B, the pulley 92A is mounted on the shaft 92 through a friction member 92B generating a predetermined rotational resistance between the pulley 92A and the shaft 92.

A value of the rotational resistance of each pulley 92A, i.e., a value of the running resistance of each endless tension belt 91 has relation to the number of the projections 91A on the endless tension belt 91 in engagement with the sprocket holes 10A in the fan-folded form 10. That is, the running resistance value should be brought to such a level that the sprocket holes 10A are not damaged or broken by the load applied thereto from the projections 91A. Further, as an essential condition, the running resistance value should not apply to the fan-folded form 10 a back-tension of such a level that the fan-folded form 10 is severed along the perforation at the nip between the upper and lower pressure rolls 81B and 81A of the fixing roll pair 81. Usually, it is appropriate to set the back-tension to 300 grams to 400 grams along one side edge of the fanfolded form 10, and to 600 grams to 800 grams on the opposite side edges thereof.

FIGS. 10A and 10B show a modification of the rotational resistance generating system. In this modification, each of pulleys 920A on the side of the photoconductive drum 1 is formed of plastic resin, and with no teeth on the outer peripheral surface so as not to mesh with the teeth of the endless tension belt 91. Thereby, a frictional force is generated between the smooth surface of the pulley 920A and the toothed surface of the endless tension belt 91.

Figure 11:
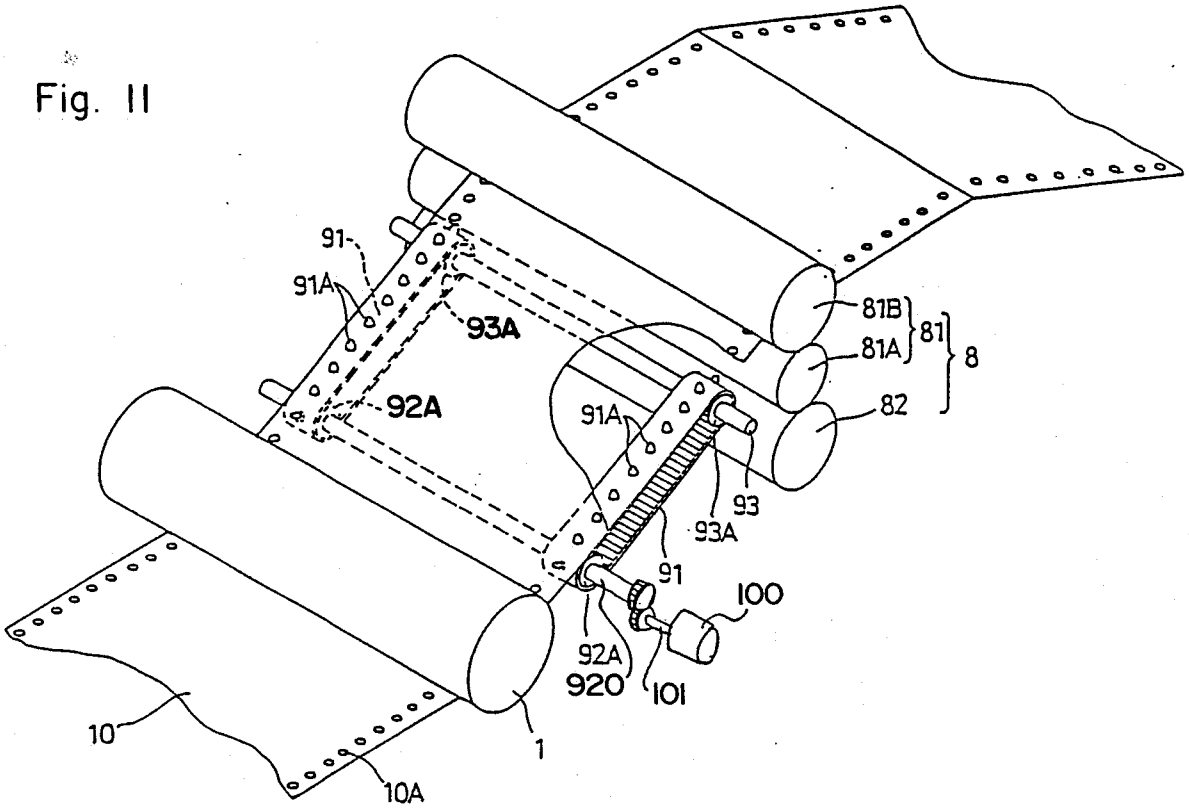
FIG. 11 is a view similar to FIG. 1, but showing a laser beam printer having incorporated therein a further modified rotational resistance generating system.

FIG. 11 shows a still further modification of the rotational resistance generating system. In this modification, the pulleys 92A and 92A on the side of the photoconductive drum 1 are secured to a shaft 920 one axial end of which is rotatably supported by the chassis (not shown). In order to impart a predetermined rotational resistance, the other axial end of the shaft 92 is gear-connected to an input shaft 101 of an electro-magnetic clutch (breaking type) 100 for generating the predetermined rotational resistance against the rotation of the pulley 92A in the transport direction of the fan-folded form 10.

In the laser beam printer constructed as described above, the fan-folded form 10 is introduced into the printer through an entrance 11. Then, the fan-folded form 10 is caused to pass through a position between the photoconductive drum 1 and the transferring station 7, and the leading edge of the fan-folded form 10 is bitten into the nip between the upper and lower pressure rolls 81B and 81A of the fixing roll pair 81. Subsequently, the projections 91A on the upper runs of the respective endless tension belts 91 and 91 are fitted respectively into the sprocket holes 10A in the fan-folded form 10. In this manner, the fan-folded form 10 is set in the printer.

When printing is executed, a laser beam from a semiconductor laser (not shown) scans the surface of the charged photoconductive drum 1, while said drum 1 is rotating in the circumferential direction at a predetermined speed, to form a latent image on the drum surface. Toner is then applied at the developing station 6 to the latent image to develop the same. Subsequently, the developed toner image is transferred at the transferring station 7 onto the fan-folded form 10. The fan-folded form 10 having carried thereon the toner image is driven to travel along the predetermined path toward the fixing station 8, by the pressure roll 81B of the fixing station 8 which is driven to rotate in synchronism with the photoconductive drum 1.

The projections 91A on the upper runs of the respective endless tension belts 91 and 91 of the tension applying mechanism 9 are inserted into and are engaged with the sprocket holes 10A along the opposite side edges of a portion of the fan-folded form 10, which extends between the photoconductive drum 1 and the fixing station 8. Thus, the endless tension belts 91 and 91 are pulled and driven to run around the respective right- and left-hand pairs of pulleys 92A and 93A and 92A and 93A, by the fan-folded form 10 driven to travel by cooperation of the upper and lower pressure rolls 81B and 81A at the fixing station 8.

Since, as described previously, the predetermined resistance is imparted to running of the endless tension belts 91 and 91, a predetermined back-tension is applied to a portion of the fan-folded form 10, which extends between the tension applying mechanism 9 and the fixing station 8.

As described above, since the predetermined back-tension is applied to the fan-folded form 10 introduced into the fixing station 8, the behavior or condition of the fan-folded form 10 introduced into the nip between the upper and lower pressure rolls 81B and 81A of the fixing roll pair 81 is made uniform, thereby preventing occurrence of skewing or meandering of the fan-folded form 10. In addition, the fan-folded form 10 is restricted in position in the lateral or widthwise direction, by the projections 91A on the endless tension belts 91 and 91. Thus, even if skewing or meandering of the fan-folded form 10 occurs for some reasons, the fanfolded form 10 is automatically restored to a predetermined position.

In the above embodiment, it has been described that ten projections 91A on each endless tension belt 91 are simultaneously engaged respectively with ten sprocket holes 10A in a corresponding one of the opposite side edges of the fan-folded form 10. It is to be noted, however, that the number of engaging projections is not specifically limited to ten. The number of engaging projections may be set to any suitable value, if the sprocket holes 10A are not damaged or broken in the relationship between the back-tension applied to the fan-folded form 10 and the strength of the sprocket holes 10A.

Further, if the image fixing apparatus is arranged in a manner described below, it is possible to quickly return the fan-folded form 10 to a predetermined position when skewing or meandering occurs. That is, the fixing conditions such as pressurizing force, the gap between the pressure rolls 81A and 81B and the like are intentionally altered between the opposite ends of the fixing roll pair 81, and the installation conditions of the fixing roll pair 81 such as inclination of the pressure rolls 81A and 81B with respect to the transport direction of the fan-folded form 10, and the like are also intentionally altered, so that the fan-folded form 10 travels so as to have a tendency to slightly skew toward one side edge of the fan-folded form 10. With such arrangement, since the fan-folded form 10 travels while being restricted in skewing by the tension applying mechanism 9, the fan-folded form 10 can quickly be returned to the predetermined position in accordance with the skewing tendency, when skewing or meandering of the fan-folded form 10 occurs.

Moreover, it is to be understood that application of the tension applying mechanism 9 described above is not limited to the apparatus wherein image fixing and transportation driving of the fan-folded form 10 are simultaneously carried out by the fixing roll pair 81. The tension applying mechanism 9 may also be applied to an apparatus wherein the fan-folded form is driven to travel by a roll arrangement for exclusive use in transportation driving, tractor belts, or any other suitable means.

Although in the aforementioned embodiment, the pressure rolls 81A, 81B are employed, it should be appreciated that a heat-roll is employed instead of the upper pressure roll 81B when the heat-roll fixing system is adopted.

As described above, the arrangement of the image fixing apparatus illustrated in FIGS. 1 and 2 is such that the plurality of projections on the endless belt means are brought into engagement respectively with the sprocket holes in the continuous form to apply a back-tension thereto. With such arrangement, it is possible to ensure application of the back-tension to the continuous form. Thus, the occurrence of skewing or meandering of the continuous form can be prevented.

Further, the continuous form in the course of traveling along the predetermined path is regulated or controlled to a predetermined position and, accordingly, the position where the continuous form is introduced into the fixing roll means is also regulated or controlled. Thus, even if skewing or meandering occurs in the continuous form, the latter is automatically restored to the predetermined position, making it possible to prevent occurrence of creases in the continuous form, that is, occurrence of defective image fixing and defective transportation of the continuous form.

Figure 3:
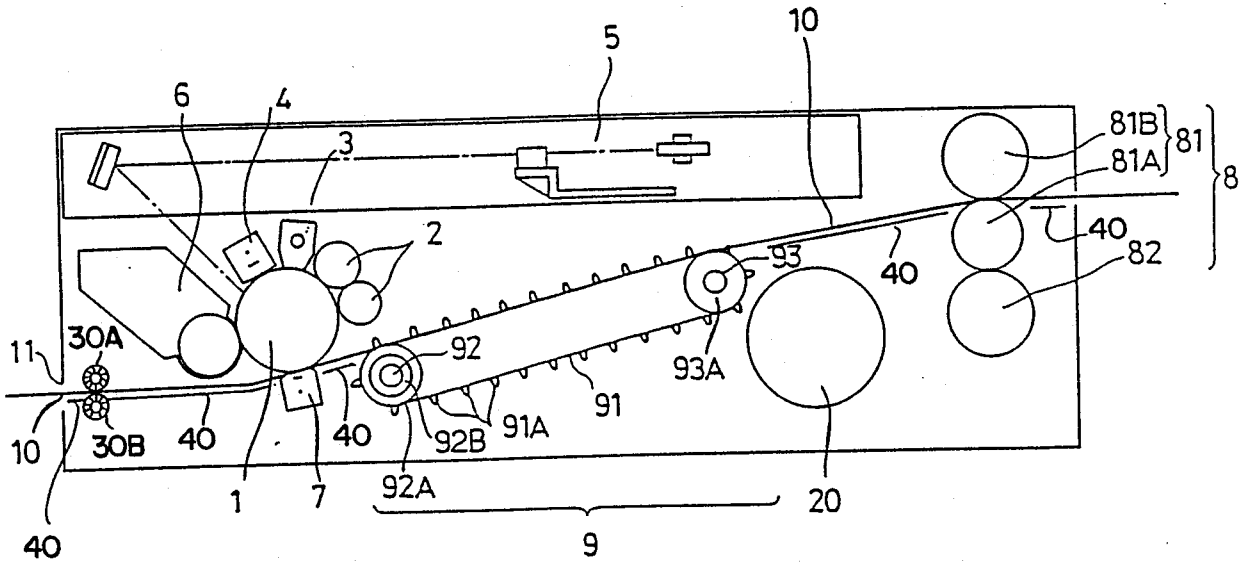
FIG. 3 is a view similar to FIG. 1, but showing a laser beam printer having incorporated therein a variation of the embodiment illustrated in FIG. 1.
Figure 4:
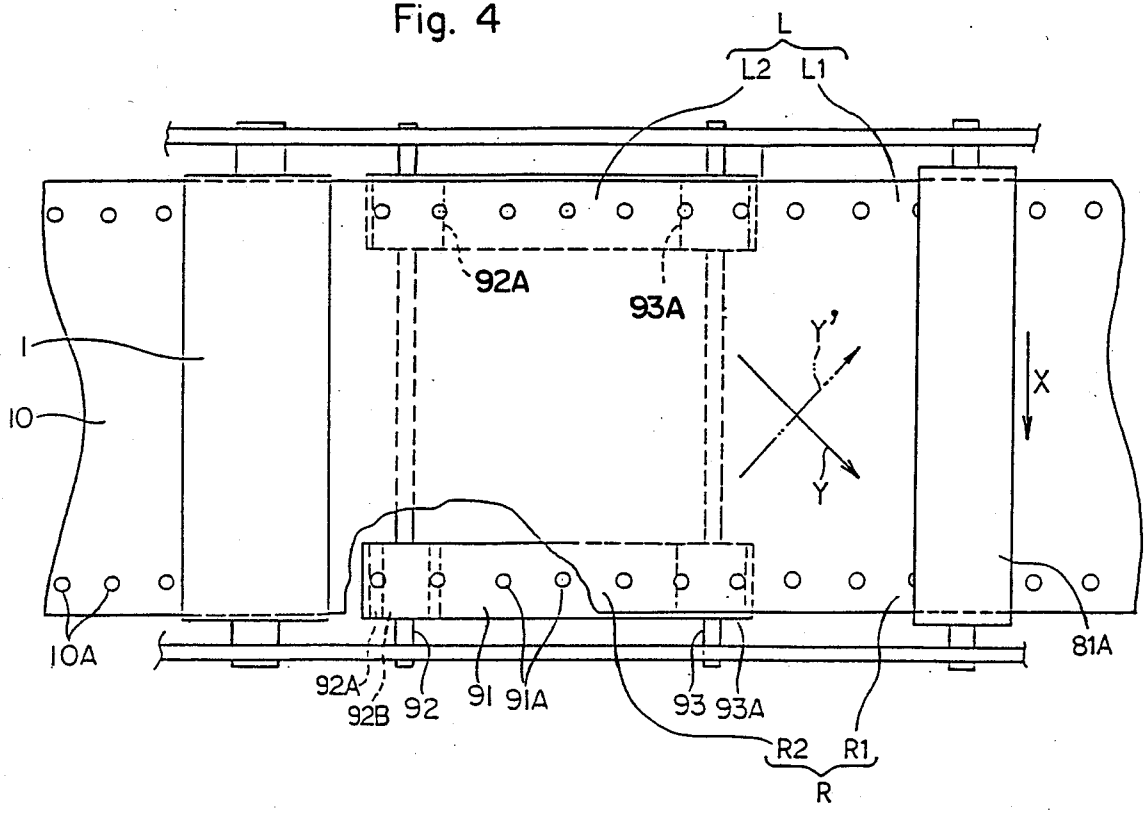
FIG. 4 is a plan view showing a meandering prevention mechanism of an image fixing apparatus illustrated in FIG. 3.

FIGS. 3 and 4 show a laser beam printer having incorporated therein a variation of the meandering prevention mechanism of the image fixing apparatus according to the invention.

The variation illustrated in FIGS. 3 and 4 is different from the embodiment illustrated in FIGS. 1 and 2 in that the shaft 92 on the side of the photoconductive drum 1 is rotatable; the pair of pulleys 92A and 92A are mounted on the rotatable shaft 92 respectively through one-way clutches 92B and 92B; and each pulley 92A is mounted on the rotatable shaft 92 against rotation relative thereto in the running direction of the upper run of a corresponding one of the endless tension belts 91 and 91, but for rotation relative to the shaft 92 in a direction opposite to the running direction.

As is well known, when the pulley 92A rotates in one-direction, the one-way clutch 92B associated with the pulley 92A is brought into engagement with the pulley 92A to prevent the latter from rotating relative to the one-way clutch 92B, while when the pulley 92A rotates in the opposite direction, the one-way clutch 92B is disengaged from the pulley 92A to permit the latter to rotate relative to the one-way clutch 92B in a slipping fashion.

The rotatable shaft 92 is mounted to a chassis 30 (see FIG. 3) of the laser beam printer for rotation relative to the chassis 30 with a predetermined rotational resistance. The pulleys 92A and 92A are mounted on the rotatable shaft 92 against rotation relative thereto in the transport direction of the fanfolded form 10, but for free rotation relative to the shaft 92 in the opposite direction.

The shaft 93 on the side of the fixing station 8 has opposite ends thereof which are fixedly mounted to the chassis 30. The pulleys 93A and 93A are mounted on the fixed shaft 93 for rotation relative thereto, at respective locations corresponding respectively to the opposite side edges of the fan-folded form 10 along which the sprocket holes 10A are formed.

Accordingly, the endless tension belts 91 and 91 trained respectively around the pulleys 92A and 93A are capable of running with a predetermined running resistance in the transport direction of the fan-folded form 10, and are also capable of running without resistance in the opposite direction.

In the image fixing apparatus illustrated in FIGS. 3 and 4, the endless tension belts 91 and 91 are adapted to run with the predetermined running resistance in the transport direction of the fan-folded form 10. By this running resistance, a predetermined back-tension is applied to a portion of the fan-folded form 10, which extends between the meandering prevention mechanism 9 and the fixing station 8, in such a fashion that the back-tension is uniform over substantially the entire width of the fan-folded form 10. The back-tension serves to standardize the behavior or condition of the fan-folded form 10 introduced into the nip between the upper and lower pressure rolls 81B and 81A of the fixing roll pair 81, thereby effectively preventing occurrence of skewing or meandering of the fan-folded form 10. If, however, skewing or meandering occurs in the fan-folded form 10 for some reasons, the back-tension in one of the opposite side edges of the fan-folded form 10 becomes different from that in the other side edge.

If, for example, the fan-folded form 10 skews in a direction X as shown in FIG. 4, a tension in a direction Y (from a point L2 to a point R1) is produced in a portion of the fan-folded form 10, which extends between the endless tension belts 91 and 91 and the fixing roll pair 81, because the projections 91A on the endless tension belts 91 and 91 are in engagement with the sprocket holes 10A in the fan-folded form 10.

If consideration is made only to the tension in the direction Y, the fan-folded form 10 tends to be loosened in an area between the point L2 and a point L1 on the side L and in an area between a point R2 and the point R1 on the side R. Since, however, the fan-folded form 10 is driven to travel by the fixing roll pair 81, the fan-folded form 10 drives the endless tension belt 91 on the side L so that a tension is produced on the side L. That is, a tension is applied to a triangular area defined by the points L1, L2 and R1.

However, the side edge of the fan-folded form 10 on the side R is still maintained loosened, and does not contribute to running driving of the endless tension belt 91 on the side R, that is, to rotational driving of the shaft 92. Thus, no tension is produced on the side R, and the pulley 92A on the side R rotates in a slipping fashion relatively to the shaft 92 in the direction opposite to the transport direction of the fan-folded form 10.

As a result, the tension applied to the side edge of the fan-folded form 10 on the side L is increased as compared with that at usual or normal transportation of the fan-folded form 10. That is, since, at the usual or normal transportation, the fan-folded form 10 drives the endless tension belts 91 and 91 respectively at the opposite side edges of the fan-folded form 10, equal or uniform tension is applied to the opposite side edges of the fan-folded form 10. However, if one of the opposite side edges of the fan-folded form 10 does not contribute to driving of a corresponding one of the endless tension belts 91 and 91, tension applied to the other side edge driving the other endless tension belt is doubled. Accordingly, as the tension applied to the side edge of the fan-folded form 10 on the side L increases, a tension is produced in a direction Y' opposite to the direction Y, that is, in a direction from the point R2 to the point L1. This tension in the direction Y' acts to correct skewing of the fan-folded form 10 so as to restore the same to the predetermined position.

In the variation illustrated in FIGS. 3 and 4, it has been described that the right- and left-hand pulleys 92A and 92A are mounted on the shaft 92 respectively through the one-way clutches 92B and 92B. It is to be noted, however, that only one of the pulleys 92A and 92A may be mounted to the shaft 92 through a one-way clutch 92B, if the image fixing apparatus is arranged in the following manner. That is, the fixing conditions such as pressurizing force, the gap between the pressure rolls 81A and 81B and the like are intentionally altered between the opposite ends of the fixing roll pair 81, and the installation conditions of the fixing roll pair 81 such as inclination of the pressure rolls 81A and 81B with respect to the transport direction of the fanfolded form 10, and the like are also intentionally altered, so that the fan-folded form 10 travels so as to have a tendency to slightly skew toward one side edge of the fan-folded form 10. In addition, only one of the pulleys 92A adjacent the one side edge of the fan-folded form 10 toward which the latter tends to skew, is mounted to the shaft 92 through the one-way clutch 92B. With such arrangement, since the fan-folded form 10 is travels while being restricted in skewing by the tension applying mechanism 9, the fan-folded form 10 can quickly be returned to the predetermined position in accordance with the skewing tendency, when skewing or meandering occurs in the fan-folded form 10. In addition, the one-way clutch between tee other pulley 92A and the shaft 92 can be dispensed with, so that the number of component parts is reduced, making it possible to reduce the cost.

Figure 5:
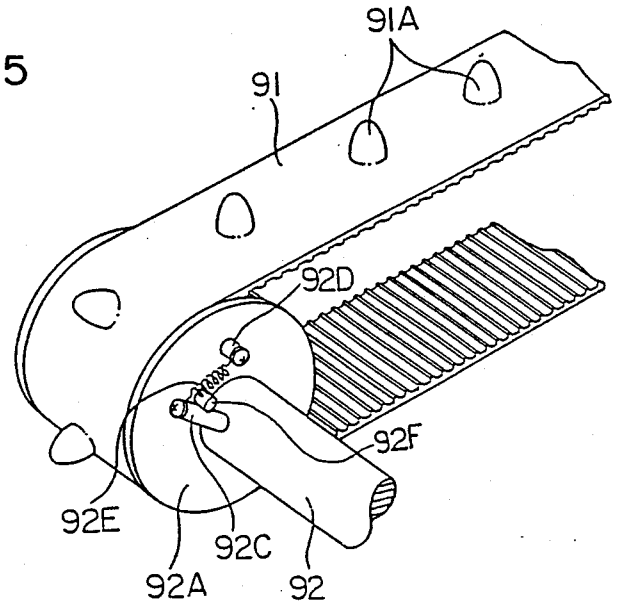
FIG. 5 is a fragmental perspective view showing a modification of the meandering prevention mechanism illustrated in FIGS. 3 and 4.

FIG. 5 shows a modification of each of the pulleys 92A and 92A which are mounted on the shaft 92 through the respective one-way clutches 92B and 92B illustrated in FIGS. 3 and 4.

In FIG. 5, the pulley 92A is mounted on the shaft 92 through the one-way clutch (see 92B in FIGS. 3 and 4) against rotation relative to the shaft 92 in the running direction of the upper run of the endless tension belt 91, but for rotation relative to the shaft 92 in a direction opposite to the running direction. An axially extending post 92D is fixedly mounted to an end face of the pulley 92A. An axially extending stopper 92F is also fixedly mounted to the end face of the pulley 92A and is circumferentially spaced a predetermined angular extent from the post 92D. A post 92C is fixedly mounted to the shaft 92 and extends radially outwardly therefrom. The posts 92D and 92C are connected to each other by a tension spring 92E.

The post 92C on the shaft 92 is pulled by the spring 92E into abutment against the stopper 92F. The tension force of the spring 92E and the spacing between the post 92D and the stopper 92F are so set that the tension force of the spring 92E is brought to a predetermined level equal to or higher than the rotational resistance of the shaft 92. That is, the predetermined back-tension is applied, through the spring 92E, to the fan-folded form 10 traveling along the predetermined path.

With the arrangement illustrated in FIG. 5, if skewing of the fan-folded form 10 occurs, the spring 92E adjacent one side edge of the fan-folded form 10 to which tension is applied, that is, on the side L in the arrangement illustrated in FIG. 4, is stretched to apply higher tension to the one side edge of the fan-folded form 10, making it possible to quickly restore the fan-folded form 10 to the predetermined position.

In the variation and the modification described above with reference to FIGS. 3 through 5, the arrangement is such that at least one of the pulleys applying the running resistance to the endless tension belts is mounted to the shaft through the rotation control means or one-way clutch in such a fashion that the pulley is rotatable relative to the shaft in the direction opposite to the transport direction of the continuous form. With such an arrangement, a difference between the tension in one of the opposite side edges of the continuous form and the tension in the other side edge at skewing of the continuous form causes the pulley to rotate relative to the shaft in the direction opposite to the transport direction. Thus, higher tension can be applied to the side edge of the continuous form opposite to the pulley, making it possible to enhance and ensure correction of the skewing.

That is, even if skewing or meandering of the continuous form occurs, the continuous form can automatically be restored to the predetermined position.

Figure 6:
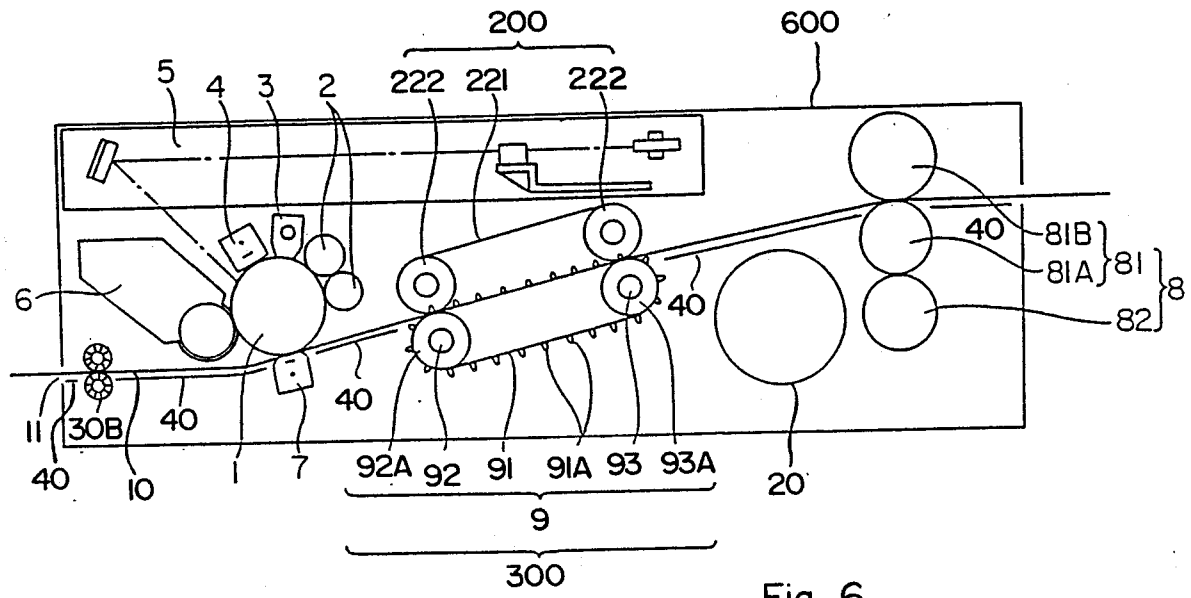
FIG. 6 is a view similar to FIG. 1, but showing a laser beam printer having incorporated therein still another variation of the embodiment illustrated in FIG. 1.
Figure 7:
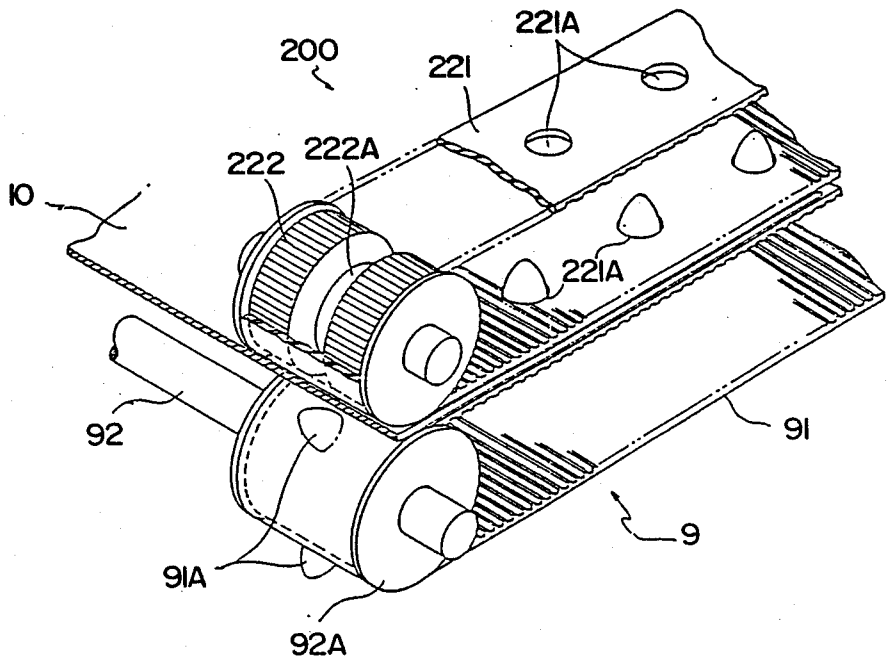
FIG. 7 is a fragmental perspective view showing a meandering prevention mechanism of an image fixing apparatus illustrated in FIG. 6.
Figure 8:
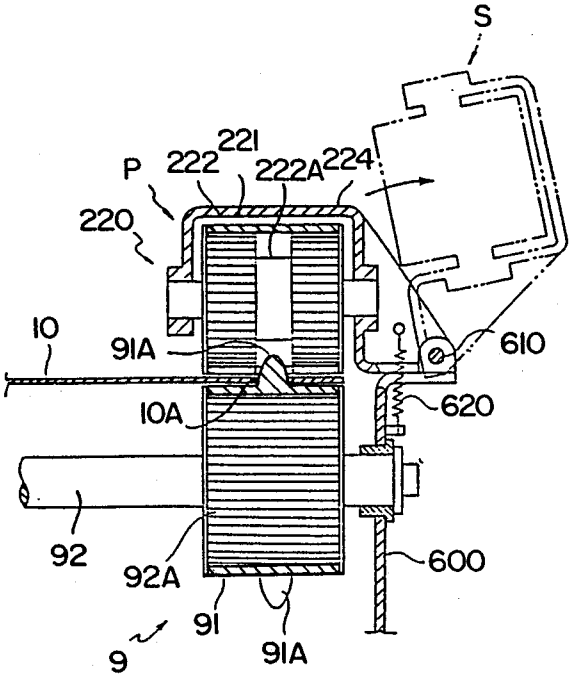
FIG. 8 is a fragmental cross-sectional view showing the meandering prevention mechanism illustrated in FIG. 7.

FIGS. 6 through 8 show a laser beam printer having incorporated therein another variation of the meandering prevention mechanism of the image fixing apparatus according to the invention.

The image fixing apparatus illustrated in FIGS. 6 through 8 comprises a meandering prevention mechanism 300 which includes, in addition to the tension applying mechanism 9, a disengagement prevention mechanism 200 for preventing the sprocket holes 10A in the fan-folded form 10 from being disengaged from the projections 91A on the endless tension belts 91 and 91.

The disengagement prevention mechanism 200 comprises a pair of endless retaining belts 221 and 221 (only one shown in the figures) which are capable of running freely. The endless retaining belts 221 and 221 are arranged respectively above the endless tension belts 91 and 91, and cooperate respectively with the endless tension belts 91 and 91 to clamp therebetween the fan-folded form 10. The endless retaining belts 221 and 221 are mounted respectively on a pair of holders 224 and 224 (only one shown in the figures) subsequently to be described.

Like the embodiment illustrated in FIGS. 1 and 2, the pulleys 93A and 93A (only one shown in the figures) on the side of the fixing station 8 are mounted on the shaft 93 for rotation relative thereto. On the other hand, the pulleys 92A and 92A (only one shown in the figures) on the photoconductive drum 1 are mounted on the shaft 92 for rotation relative thereto with a predetermined rotational resistance. Thus, each of the pulleys 92A and 92A is adapted to rotate about the axis of the shaft 92 so as to impart a predetermined resistance to running of a corresponding one of the endless tension belts 91 and 91 in the transport direction of the fan-folded form 10.

Each endless retaining belt 221 is a synchronous belt like the endless tension belts 91 and is trained around a corresponding pair of freely rotatable pulleys 222 and 222. A plurality of fixing bores 221A are formed in the endless retaining belt 221 in spaced relation to each other along the entire periphery thereof. The fixing bores 221A each have a diameter slightly larger than that of the projections 91A on the endless tension belt 91. The fixing bores 221A are spaced from each other at a pitch (½ inch) equal to that of the projections 91A.

Each of the pulleys 222 has an outer peripheral surface formed with teeth in mesh with teeth formed on an inner peripheral surface of the endless retaining belt 221. The pulley 222 is provided at its axial center with a circumferential groove 222A. The pulleys 222 and 222 are rotatably supported by the holder 224, and are arranged respectively above the pulleys 92A and 93A of the tension applying mechanism 9.

The circumferential groove 222A formed in each pulley 222 serves to permit passage of the projections 91A on the endless tension belt 91 which are fitted respectively into the fixing bores 221A in the endless retaining belt 221. If rotation of the pulley 222 is arranged so as to be brought into correct synchronism with running of the endless retaining belt 221, a plurality of bores each having a predetermined depth, into which the projections 91A are respectively fitted, may be formed in the outer peripheral surface of the pulley 222, in substitution for the circumferential groove 222A.

Each holder 224 is mounted, through a corresponding pivot 610, to a frame 600 for the entire laser beam printer. As shown in FIG. 8, the holder 224 is angularly movable toward and away from the endless tension belt 91 about the pivot 610 between an operative position P indicated by the solid lines and a form setting position S indicated by the phantom lines. In the operative position P, the lower run of the endless retaining belt 221 trained around the pulleys 222 and 222 cooperates with the upper run of the endless tension belt 91 to define therebetween a predetermined gap to clamp the fan-folded form 10 between the endless belts 221 and 91. In the form setting position S, the fanfolded form 10 can be so set that the sprocket holes 10A are fitted respectively about the projections 91A.

An over-center biasing spring 620 is provided which has one end anchored at a predetermined location on the frame 600 and the other end anchored at a predetermined position on the holder 224 between the pulleys 222 and the pivot 610. By the biasing force of the over-center spring 620, the holder 224 can be retained in a stable fashion at the respective operative and form setting positions P and S.

As described above, the arrangement of the disengagement prevention mechanism 200 is such that each of the pair of endless retaining belts 221 and 221 capable of freely running is supported on the frame 600 by a corresponding one of the pair of holders 224 and 224, and is angularly movable about the corresponding pivot 620 between the form setting position S and the operative position P where the endless retaining belt 221 cooperates with a corresponding one of the pair of endless tension belts 91 and 91 to clamp therebetween the fan-folded form 10.

In the laser beam printer constructed as described above, the endless retaining belts 221 and 221 of the disengagement prevention mechanism 200 are angularly moved about the respective pivots 610 and 610 to the respective form setting positions S. The fan-folded form 10 introduced through the entrance 11 through the position between the photoconductive drum 1 and the transferring station 7. Then, the projections 91A on the endless tension belts 91 and 91 of the tension applying mechanism 9 are fitted respectively into the sprocket holes 10A in the fan-folded form 10. Subsequently, the leading edge of the fan-folded form 10 is bitten into the nip between the upper and lower pressure rolls 81B and 81A of the fixing roll pair 81. The holders 224 and 224 of the disengagement prevention mechanism 200 are then angularly moved about the respective pivots 610 and 610 from the respective form setting positions S to the respective operative positions P, to fit the fixing bores 221A in the endless retaining belts 221 respectively about the projections 91A extending respectively through the sprocket holes 10A in the fan-folded form 10.

During printing, the predetermined back-tension is applied to the fan-folded form 10 introduced into the fixing station 8, to standardize the behavior or condition of the fan-folded form 10 introduced into the nip between the upper and lower pressure rolls 81B and 81A of the fixing roll pair 81. In addition, the widthwise position of the fan-folded form 10 with respect to the fixing station 8 is restricted by the endless tension belts 91 and 91. Thus, skewing or meandering of the fan-folded form 10 is prevented from occurring, in a manner like that described previously with reference to the embodiment illustrated in FIGS. 1 and 2.

Even if skewing or meandering of the fan-folded form 10 occurs, the fan-folded form 10 is automatically restored to the predetermined position. Further, the endless retaining belts 221 and 221 effectively prevent disengagement of the sprocket holes 10A in the fan-folded form 10 from the projections 91A on the endless tension belts 91 and 91, which might occur due to deformation of the fan-folded form 10. Thus, it is ensured to correct the skewing or meandering, to thereby restore the fan-folded form 10 to the predetermined position.

In the variation illustrated in FIGS. 6 through 8, it has been described that the running resistance is applied to the endless tension belts 91 and 91, while the endless retaining belts 221 and 221 are capable of running freely. It is to be understood, however, that running resistance may be applied to the endless retaining belts 221 and 221. In this case, the endless tension belts 91 and 91 are arranged so as to be capable of running freely.

Further, it is needless to say that projections may be formed on the endless retaining belts 221 and 221. In this case, the fitting bores are formed in the endless tension belts 91 and 91.

As described above, the arrangement of the image fixing apparatus illustrated in FIGS. 6 through 8 is such that a plurality of projections are formed on one of the endless tension belt means and the endless retaining belt means, while a plurality of fitting bores are formed in the other endless belt means, wherein the projections are fitted respectively into the fitting bores through the sprocket holes in the continuous form, to thereby apply a predetermined back-tension to the continuous form. With such arrangement, the sprocket holes in the continuous form can be prevented from being disengaged from the projections.

Thus, it is made possible for the arrangement illustrated in FIGS. 6 through 8 to ensure that the predetermined back-tension is applied to the continuous form, thereby preventing skewing or meandering of the continuous form from occurring. Further, it is made possible to ensure that, when skewing or meandering of the continuous form occurs, the continuous form is automatically restored to the predetermined position.

What is claimed is:

1. An image fixing apparatus for fixing an image on a continuous form to record the image thereonto, the continuous form having sprocket holes formed along each of opposite side edges of the continuous form, which comprises:

drive means for driving the continuous form to travel along a predetermined path;

fixing roll means arranged in said predetermined path, for applying pressure and/or heat to the image to fix the same onto the continuous form; and endless belt means arranged upstream of said fixing roll means with reference to a transport direction in which the continuous form travels along said predetermined path, said endless belt means having provided thereon a plurality of projections arranged in spaced relation to each other along an outer peripheral surface of said endless belt means, said projections being engageable with the sprocket holes formed in the continuous form so that the continuous form transmits a driving force to said endless belt means, said endless belt means being capable of running in said transport direction while applying a predetermined back-tension to the continuous form traveling toward said fixing roll means along said predetermined path.

2. The image fixing apparatus according to claim 1, which further comprises:

a pair of first and second shaft means having their respective axes extending perpendicularly to said transport direction, said first and second shaft means being spaced from each other along said predetermined path; and a pair of first and second pulley means mounted respectively on said first and second shaft means for rotation about the axes of the respective first and second shaft means, said endless belt means passing around said first and second pulley means, wherein said first shaft means is mounted against rotation about its axis, and said first pulley means is mounted on said first shaft means for rotation relative thereto with a predetermined rotational resistance to provide said predetermined back-tension.

3. The image fixing apparatus according to claim 2, wherein a friction member is inserted between said first shaft means and said first pulley means.

4. The image fixing apparatus according to claim 2, wherein said endless belt means has an inner peripheral surface formed with teeth, and said second pulley means has an outer peripheral surface formed with teeth in mesh with the teeth on said endless belt means, while said first pulley means has an even peripheral surface for generating the predetermined rotational resistance between said first pulley means and said endless belt means.

5. The image fixing apparatus according to claim 2, wherein said endless belt means comprises a pair of endless belts extending along said predetermined path, said pair of endless belts being spaced from each other perpendicularly to said transport direction, each of said pair of endless belts having provided thereon the projections engageable with the sprocket holes formed along a corresponding one of the opposite side edges of the continuous form.

6. The image fixing apparatus according to claim 5, wherein said first pulley means includes a pair of pulleys spaced from each other along said first shaft means, said pair of pulleys being mounted on said first shaft means for rotation relative thereto with said predetermined rotational resistance, and wherein said second pulley means includes a pair of pulleys mounted on said second shaft means for rotation about the axis thereof in spaced relation to each other along said second shaft means, said pair of endless belts passing respectively around said pair of pulleys of said first pulley means and said pair of pulleys of said second pulley means.

7. The image fixing apparatus according to claim 2, wherein said endless belt means has an inner peripheral surface formed with teeth, and each of said first and second pulley means has an outer peripheral surface formed with teeth in mesh with the teeth on said endless belt means.

8. The image fixing apparatus according to claim 1, wherein said fixing roll means comprises a pair of fixing rolls, at least one of which is a heat fixing roll.

9. The image fixing apparatus according to claim 1, wherein said fixing roll means comprises a pair of pressure fixing rolls having their respective axes extending in parallel relation to each other and perpendicularly to said transport direction, said pair of pressure fixing rolls defining therebetween a nip through which said predetermined path extends, said pair of pressure fixing rolls cooperating with each other to apply pressure to the image on the continuous form passing through said nip to fix the image onto the continuous form.

10. The image fixing apparatus according to claim 9, which further comprises a motor for driving at least one of said pair of pressure fixing rolls, whereby said pair of pressure fixing rolls serve as said drive means.

11. The image fixing apparatus according to claim 10, wherein said endless belt means is run by the continuous form driven to travel by said pair of pressure fixing rolls.

12. The image fixing apparatus according to claim 1, which further comprises:

a pair of first and second shaft means having their respective axes extending perpendicularly to said transport direction, said first and second shaft means being spaced from each other along said predetermined path;

a clutch connected to one axial end of said first shaft means; and a pair of first and second pulley means mounted respectively on said first and second shaft means for rotation about the axes of the respective first and second shaft means, said endless belt means passing around said first and second pulley means, wherein said first pulley means is fixedly mounted on said first shaft means against rotation relative thereto, and wherein said clutch generates a predetermined rotational resistance to provide said predetermined back-tension.

13. An image fixing apparatus for fixing an image on a continuous form to record the image thereonto, the continuous form having sprocket holes formed along each of opposite side edges of the continuous form, which comprises:

drive means for driving the continuous form to travel along a predetermined path;

fixing roll means arranged in said predetermined path, for applying pressure and/or heat to the image to fix the same onto the continuous form;

a pair of first and second endless belts arranged upstream of said fixing roll means with reference to a transport direction in which the continuous form travels along said predetermined path, said first and second endless belts being capable of running in parallel relation to said transport direction and being spaced from each other perpendicularly to said transport direction, each of said first and second endless belts having provided thereon a plurality of projections arranged in spaced relation to each other along an outer peripheral surface of the endless belt, said projections on each of said first and second endless belts being engageable with the sprocket holes formed along a corresponding one of the opposite side edges of the continuous form so that the continuous form transmits a driving force to said endless belts;

a pair of first and second pulley means arranged in spaced relation to each other along said predetermined path, at least said first pulley means of said first and second pulley means having a pair of spaced pulleys, said first endless belt passing around one of said pair of pulleys and said second pulley means, and said second endless belt passing around the other pulley and said second pulley means;

a shaft having an axis extending perpendicularly to said transport direction, said pair of pulleys being mounted on said shaft, said shaft being rotatable about its axis with a predetermined rotational resistance to impart a resistance to running of said first and second endless belts thereby applying a predetermined back-tension to the continuous form traveling toward said fixing roll means along said predetermined path; and rotation control means arranged between at least one of said pair of pulleys and said shaft, for preventing the at least one pulley from rotating relative to said shaft in a running direction of one of said first and second endless belts, which is associated with the at least one pulley, but for permitting the at least one pulley to rotate relative to said shaft in a direction opposite to said running direction.

14. The image fixing apparatus according to claim 13, wherein said rotation control means comprises a pair of one-way clutches, said pair of pulleys being mounted on said shaft respectively through said one-way clutches.

15. The image fixing apparatus according to claim 14, which further comprises: a pair of first posts fixedly mounted respectively to said pair of pulleys;

a pair of stoppers fixedly mounted respectively to said pair of pulleys and circumferentially spaced respectively from said first posts;

a pair of second posts fixedly mounted to said shaft in spaced relation to each other along said shaft and extending radially outwardly from said shaft; and a pair of springs arranged respectively between said first posts and said second posts for biasing said second posts into abutment respectively against said stoppers, each of said springs having a biasing force at least equal to said rotational resistance applied to said shaft.

16. The image fixing apparatus according to claim 13, wherein said fixing roll means comprises a pair of pressure fixing rolls having their respective axes extending in parallel relation to each other and perpendicularly to said transport direction, said pair of pressure fixing rolls defining therebetween a nip through which said predetermined path extends, said pair of pressure fixing rolls cooperating with each other to apply pressure to the image on the continuous form passing through said nip to fix the image onto the continuous form.

17. The image fixing apparatus according to claim 16, which further comprises a motor for driving at least one of said pair of pressure fixing rolls, whereby said pair of pressure fixing rolls serve as said drive means.

18. The image fixing apparatus according to claim 17, wherein said first and second endless belts are run by the continuous form driven to travel by said pair of pressure fixing rolls.

19. The image fixing apparatus according to claim 13, wherein each of said first and second endless belts has an inner peripheral surface formed with teeth, and each of said first and second pulley means has an outer peripheral surface formed with teeth, the teeth on the first and second endless belts being in mesh with the teeth on the first and second pulley means.

20. An image fixing apparatus for fixing an image on a continuous form to record the image thereonto, the continuous form having sprocket holes formed along each of opposite side edges of the continuous form, which comprises:

drive means for driving the continuous form to travel along a predetermined path;

fixing roll means arranged in said predetermined path, for applying pressure and/or heat to the image to fix the same onto the continuous form;

a pair of first and second endless belt means arranged upstream of said fixing roll means with reference to a transport direction in which the continuous form travels along said predetermined path, said first and second endless belt means being capable of running in said transport direction while clamping the continuous form between said first and second endless belt means;

a plurality of projections provided on said first endless belt means and arranged in spaced relation to each other along an outer peripheral surface of said first endless belt means; and a plurality of fixing bores formed in said second endless belt means and arranged in spaced relation to each other along a periphery of said second endless belt means, wherein said projections are engageable with the sprocket holes formed in the continuous form and are engageable with the fixing bores formed in said second endless belt means through the sprockets holes so that the continuous form transmits a driving force to said endless belt means, and wherein at least one of said first and second endless belt means is capable of running in said transport direction while applying a predetermined back-tension to the continuous form traveling toward said fixing roll means along said predetermined path.

21. The image fixing apparatus according to claim 20, wherein said first endless belt means is capable of running in said transport direction while applying said predetermined back-tension to the continuous form, and said second endless belt means is capable of running freely, said image fixing apparatus including:

a pair of first and second shaft means having their respective axes extending perpendicularly to said transport direction, said first and second shaft means being spaced from each other along said predetermined path; and a pair of first and second pulley means mounted respectively on said first and second shaft means for rotation about the axes of the respective first and second shaft means, said first endless belt means passing around said first and second pulley means, wherein said first shaft means is mounted against rotation about its axis, and said first pulley means is mounted on said first shaft means for rotation relative thereto with a predetermined rotational resistance to provide said predetermined back-tension.

22. The image fixing apparatus according to claim 21, wherein said first endless belt means comprises a pair of endless belts extending along said predetermined path, said pair of endless belts being spaced from each other perpendicularly to said transport direction, each of said pair of endless belts having provided thereon the projections engageable with the sprocket holes formed along a corresponding one of the opposite side edges of the continuous form.

23. The image fixing apparatus according to claim 22, wherein said first pulley means includes a pair of pulleys spaced from each other along said first shaft means and mounted on said first shaft means for rotation relative thereto with said predetermined rotational resistance, and said second pulley means includes a pair of pulleys mounted on said second shaft means for rotation about the axis thereof in spaced relation to each other along said second shaft means, said pair of endless belts passing respectively around said pair of pulleys of said first pulley means and said pair of pulleys of said second pulley means.

24. The image fixing apparatus according to claim 21, wherein said first endless belt means has an inner peripheral surface formed with teeth, and each of said first and second pulley means has an outer peripheral surface formed with teeth in mesh with the teeth on said first endless belt means.

25. The image fixing apparatus according to claim 21, wherein said second endless belt means is angularly movable about a pivotal axis toward and away from said first endless belt means between an operative position where said first and second endless belt means cooperate with each other to clamp therebetween the continuous form and a form setting position where the continuous form can be so set that the projections are fitted respectively into the sprocket holes of the continuous form.

26. The image fixing apparatus according to claim 25, wherein said first endless belt means comprises a pair of endless belts extending along said predetermined path, said pair of endless belts being spaced from each other perpendicularly to said transport direction, each of said pair of endless belts having provided thereon the projections engageable with the sprocket holes formed along a corresponding one of the opposite side edges of the continuous form, and wherein said second endless belt means comprises a pair of endless belts, each of said pair of endless belts of said second endless belt means having provided therein the fixing bores engageable with the projections on a corresponding one of said pair of endless belts of said first endless belt means, said pair of endless belts of said second endless belt means cooperating respectively with said pair of endless belts of said first endless belt means to clamp therebetween the continuous form, each of said pair of endless belts of said second belt means being angularly movable toward and away from a corresponding one of said pair of endless belts of said first belt means between said operative position and said form setting position.

27. The image fixing apparatus according to claim 20, wherein said fixing roll means comprises a pair of pressure fixing rolls having their respective axes extending to parallel relation to each other and perpendicularly to said transport direction, said pair of pressure fixing rolls defining therebetween a nip through which said predetermined path extends, said pair of pressure fixing rolls cooperating with each other to apply pressure to the image on the continuous form passing through said nip to fix the image onto the continuous form.

28. The image fixing apparatus according to claim 27, which further comprises a motor for driving at least one of said pair of pressure fixing rolls, whereby said pair of pressure rolls serve as said drive means.

29. The image fixing apparatus according to claim 28, wherein said first and second endless belt means are run by the continuous form driven to travel by said pair of pressure fixing rolls.

* * * * *

UNITED STATES PATENT AND TRADEMARK OFFICE

CERTIFICATE OF CORRECTION

PATENT NO. : 4,890,140

DATED : December 26, 1989

INVENTOR(S) : Ikuo NEGORO et al.

It is certified that error appears in the above-identified patent and that said Letters Patent is hereby corrected as shown below:

column 10, line 60, delete "is" after "10";
column 10, line 66, change "tee" to —the—; and
column 13, line 25, after "11" insert —passes—.

Signed and Sealed this

Twenty-eighth Day of April, 1992

*Attest:*

HARRY F. MANBECK, JR.

*Attesting Officer*

*Commissioner of Patents and Trademarks*